United States Patent [19]

Yano

[11] 4,035,069

[45] July 12, 1977

[54] EXPOSURE AND DEVELOPMENT SYSTEM FOR ELECTROPHOTOGRAPHY

[75] Inventor: Takashi Yano, Tokyo, Japan

[73] Assignee: Ricoh Company, Ltd., Tokyo, Japan

[21] Appl. No.: 594,181

[22] Filed: July 8, 1975

[30] Foreign Application Priority Data

July 12, 1974 Japan ..... 49-79993

[51] Int. Cl.[2] ..... G03G 15/00

[52] U.S. Cl. ..... 355/3 R; 355/3 DD; 355/14; 355/69; 355/71

[58] Field of Search ..... 355/3 R, 14, 17, 3 DD, 355/67–69, 71, 83

[56] References Cited

U.S. PATENT DOCUMENTS

| | | | |
|---|---|---|---|
| 3,700,323 | 10/1972 | Guyette et al. | 355/14 X |
| 3,788,739 | 1/1974 | Coriale | 355/17 |
| 3,877,803 | 4/1975 | Seliger | 355/3 CH |

*Primary Examiner*—R. L. Moses

*Attorney, Agent, or Firm*—Frank J. Jordan

[57] ABSTRACT

In order to improve the reproduction of low contrast originals, the exposure intensity is reduced to a value at which the difference in brightness of the light and dark areas of the original will produce a maximum difference in electric potential on a photoconductive drum. The voltage applied to a developing electrode is increased to prevent darkening of the light areas of the copy.

13 Claims, 4 Drawing Figures

EXPOSURE AND DEVELOPMENT SYSTEM FOR ELECTROPHOTOGRAPHY

The present invention relates to a method and apparatus for electrophotography for improving the contrast of copies of low contrast original documents.

In the art of electrophotography, original documents having low density and contast, such as those made by the diazo process, are extremely difficult to reproduce. Low density means that even the dark areas of the document are rather light and low contrast means that the difference between the dark areas and light areas is small.

The prior art includes methods such as cascade development, neutral toner polarization and utilization of edge effects to overcome this problem. Although these methods are sometimes satisfactory for line documents, they are not suitable for the reproduction of gray scales.

A recourse is known to reduce the brightness of illumination of the imaging light source in order to increase the contrast of the reproduction. This, however, results in a darkening of the light or background areas of the copy.

It is also known in the art to reduce the voltage applied to a developing electrode in order to make a low density image visible in the copy. This method does not increase the contrast of the copy and also results in darkening of the background areas.

It is therefore an object of the present invention to provide a method of increasing the contrast of an electrophotographic reproduction of a low density and contrast document without darkening the background areas.

It is a further object of the present invention to provide electrophotographic apparatus embodying the method.

The above and other objects, features and advantages of the present invention will become clear from the following detailed description taken with the accompanying drawings, in which.

Figure 3:
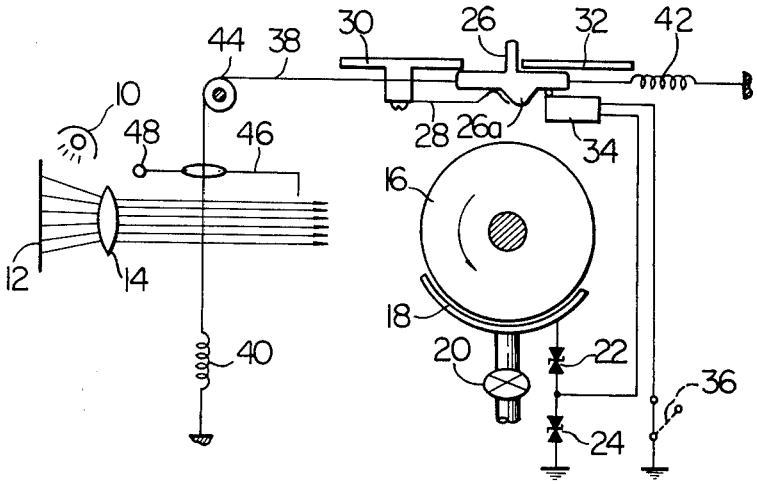
FIG. 3 is a schematic drawing of electrophotographic apparatus embodying the present invention.

Referring now to FIG. 3, the process of electrostatically copying an original document having normal contrast is graphically illustrated. The abscissa axis is linearly graduated and represents the intensity of illumination Q of a light image of an original document incident on a photoconductive member such as a drum. The left ordinate axis is linearly graduated and represents the voltage V remaining on the drum after exposure to light of intensity Q for a predetermined length of time. The right ordinate axis represents the density of the image produced on a copy sheet which corresponds to the voltage V. A curve $V = f(Q)$ represents the photoconductivity characteristic of the photoconductive drum.

The intensity of light from the background or light areas of the document is represented by $Q_L$ whereas the intensity of light from the darkest areas of the document is represented by $Q_D$. The drum is charged before exposure, and the charge is dissipated by photoconductivity upon exposure to the light image of the document in such a manner that the remaining voltage or potential on the drum in the light and dark areas of the image is $V_L$ and $V_D$ respectively. The voltages correspond to densities on the copy of $D_L$ and $D_D$ respectively.

The method utilizes a developing electrode or counter electrode disposed adjacent to the drum which is biased to a voltage $V_B$ which corresponds to a density $D_B$ which is slightly lower than the density $D_L$ of the background areas so that toner particles will be attracted to the developing electrode rather than to the background areas of the electrostatic image on the drum. By this means, the densitites of the light and dark areas on the copy become $D_L'$ and $D_D'$ which are equal to $(D_L-D_B)$ and $(D_D-D_B)$ respectively. The contrast range of the copy is thereby $D_C$ which is equal to $(V_D-V_L)$.

Figure 1:
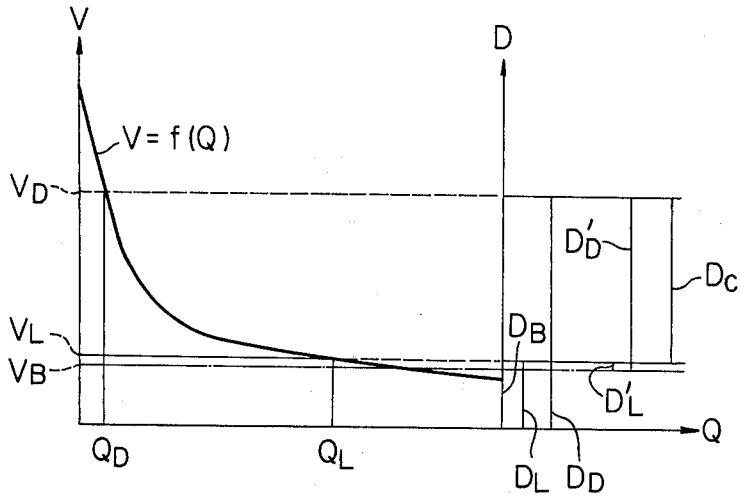
FIG. 1 is a graph illustrating a method of electrostatically copying a normal contrast document.
Figure 2:
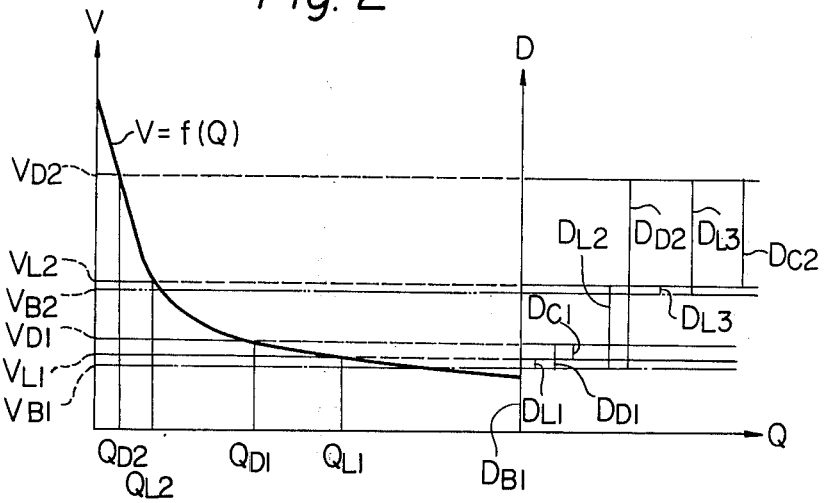
FIG. 2 is a graph illustrating a method of copying a low contrast document.

Referring now to FIG. 2, the electrophotographic method is illustrated for a low contrast original. The intensity of the light areas $Q_{L1}$ is the same as the intensity $Q_L$ of the normal contrast document. However, the intensity of the darkest areas $Q_{D1}$ is higher than the intensity $Q_D$ for the normal contrast document. With a biasing voltage $V_{B1}$ which is equal to $V_B$ corresponding to a density $D_{B1}$, the voltage $V_{L1}$ and density $D_{L1}$ of the light areas will be equal to the voltage $V_L$ and density $D_L'$ respectively. However, the voltage $V_{D1}$ and density $D_{D1}$ of the dark areas will be considerable less than the voltage $V_D$ and density $D_D'$ respectively. The contrast $D_{C1}$ which is equal to $(D_{D1}-D_{L1})$ is much less than the contrast $D_C$ of the normal contrast document.

Examination of the curve $V = F(Q)$ will disclose that the slope thereof is greater near the V axis than near the D axis. This fact is utilized to increase the contrast of the copy. Specifically, the intensity of the entire light image is uniformly reduced so that the intensity of the dark areas $Q_{D2}$ is equal to the intensity $Q_D$ of the normal contrast document. The intensity of the light areas then has a value $Q_{L2}$. The corresponding voltages on the drum are $V_{D2}$ and $V_{L2}$ respectively.

The densities corresponding to the voltages $V_{D2}$ and $V_{L2}$ and $D_{D2}$ and $D_{L2}$ respectively, which produce a contrast $D_{C2}$ which is much greater than the contrast $D_{C1}$. It will be understood that since the intensities $Q_{L2}$ and $Q_{D2}$ correspond to a region of steep slope of the curve $V = f(Q)$, a given difference in intensities will produce a greater difference in voltages on the drum than in the region near the D axis. In this manner, the contrast of the copy is increased by decreasing the intensity of the light image incident on the photoconductive drum.

It will be seen that the density $D_{D2}$ is equal to the density $D_D'$ of the normal contrast document. It will also be noticed that the density $D_{L2}$ is greater than the density $D_L'$ of the normal contrast document by which the background areas of the copy will be undesirably darkened. This effect is eliminated by increasing the biasing voltage on the developing electrode to a value $V_{B2}$, which reduces the densities of the light and dark areas to $D_{L3}$ and $D_{D3}$ respectively. The density $D_{L3}$ is made equal to the density $D_L'$ through suitable selection of the voltage $V_{B2}'$ and the contrast is maintained at the same value $D_{C2}$. The overall result is that the contrast is increased without undesirably darkening the background areas of the copy. It will be understood that the biasing voltage $B_{B2}$ may be made equal to the voltage $V_{L2}$ if desired to further reduce the possibility of a darkened background.

The idea of the invention comprises selecting the intensity of the light image in such a manner that a given intensity difference in the light image will produce a maximum voltage difference on the photoconductive drum. This may be calculated in the following manner.

Within a useful intensity range in which the law of reciprocity is valid, for any document the ratio of the intensities of the light and dark areas will be constant, or $$\frac{Q_L}{Q_D} = K \qquad (1)$$

where $K$ is a constant having a value greater than unity and representing the contrast range of the original document.

Subtracting the intensity of the dark areas $Q_D$ from both sides of equation (1) produces the difference in intensity between the light and dark areas $$Q_L - Q_D = Q_D(K-1) \qquad (2)$$

The photoconductivity of the drum is represented as $$V = f(Q)$$

For small values of $Q_L - Q_D'$ the following approximation is valid $$\frac{V_D - V_L}{Q_D - Q_L} \simeq -\frac{\delta f}{\delta Q}(Q_L - Q_D)_{Q=Q_D} \simeq -(K-1)\frac{\delta f}{\delta Q}(Q)_{Q=Q_D} \qquad (4)$$

Equation (4) represents the rate of change of the pholoconductivity of the drum as a function of the difference between the intensitites of the light and dark areas of the light image or the change in the intensity $Q$. In order to obtain maximum image contrast, the intensity of the dark areas $Q_D$ is chosen so that the value of $$\left|\frac{\delta f}{\delta Q}(Q)\right|_{Q=Q_D} \qquad (5)$$

is maximum. The bias voltage $V_{B2}$ for the developing electrode is then set substantially equal to the voltage $V_D$ corresponding to the chosen intensity $Q_D$. In actual practice, the intensity difference $Q_L - Q_D$ for a document having a minimum contrast which is to be reproduced by the electrophotographic apparatus is determined and the values $Q_D$ and $V_{B2}$ for low contrast reproduction are decided in dependence thereon.

FIG. 3 shows an electrophotographic apparatus embodying the present invention. A lamp 10 is provided to illuminate an original document 12 which is to be electrophotographically copied or reproduced. An imaging lens 14 produces a light image of the document 12 and radiates the same on the surface of a photoconductive drum 16 which is driven to rotate counterclockwise and has the photoconductive characteristic illustrated by the curve $V = f(Q)$. A developing tray 18 which serves as a developing electrode is located below the drum 16 and filled with a liquid developer by a pump 20 so that the bottom surface of the drum 16 is immersed in the developer. In operation, the drum 16 is charged by a charging unit (not shown) and imaged by the lens 14. The drum 16 locally conducts in areas where the light image is bright so that the charge voltage is dissipated in these areas. In this manner an electrostatic image is formed on the drum 16. In the electrode or tray 18, toner particles in the developer are attracted to the high voltage areas (dark areas) of the electrostatic image and adhere to the drum. The toner image thus developed or produced is transferred to a copy paper (not shown) and fixed thereto in a conventional manner.

The apparatus further comprises zener diodes 22 and 24 connected between the electrode 18 and ground. The electrode 18 acquires a self-bias voltage due to the proximity of the drum 16 which is maintained constant by the zener diodes 22 and 24. A slider 26 is slidable left and right and maintained in either of left and right positions by means of a detent projection **26*a*, a dentent spring 28 and stops 30 and 32. A normally open switch 34 has one end connected to the junction between the zener diodes 22 and 24 and the other end grounded through a switch 36. The slider 26 closes the switch 34 when in its right position and allows the switch 34** to open when in its left position.

A wire 38 is tensioned between springs 40 and 42 and trained around a pulley 44. A light valve here shown as a shutter 46 is pivotal about a point 48. The wire 38 is connected to both the slider 26 and the shutter 46.

The breakdown voltage of the zener diode 22 is selected to be $V_{B1}$ whereas the breakdown voltage of the zener diode 24 is selected to be $V_{B2}-V_{B1}$ so that the zener diodes 22 and 24 connected in series have a breakdown voltage of $V_{B2}$. For documents of normal contrast, the slider 26 is moved to its right position and the switch 36 is closed. The slider 26 in its right position closes the switch 34 to complete a path to ground from the junction of the zener diodes 22 and 24. The zener diode 24 is effectively shorted out so that the voltage $V_{B1}$ is applied to the developing electrode 18. When in the right position, the slider 26 pulls the wire 38 so that the shutter 46 is moved out of the path of the light image from the lens 14.

For documents of low contrast, the slider 26 is moved to its left position to open the switch 34. The electrode 18 is therefore grounded through both zener diodes 22 and 24 and the voltage applied thereto is $V_{B2}$. The slider 26 moves the wire 38 so that the shutter 46 is positioned in the path of the light image from the lens 14 to partially block the same and reduce the intensity thereof. The shutter 46 is designed so that the intensity of the dark areas of the image is adjusted to $Q_D$ as determined by equation (5). In this manner, the bias voltage on the developing electrode 18 is increased to $V_{B2}$ and the intensity of the light image is reduced to increase the contrast of the copy.

With the slider 26 in its right position for normal documents, the switch 36 may be opened to increase the biasing voltage on the electrode 18 without decreasing the intensity of the light image. This is useful for increasing the density of documents which have normal contrast but low density.

Figure 4:
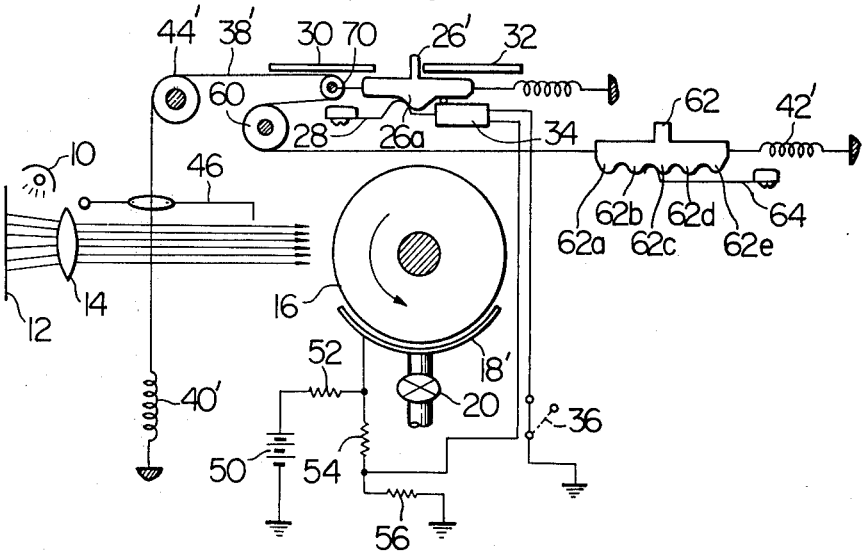
FIG. 4 is similar to FIG. 3 but shows a modified embodiment.

In FIG. 4, identical elements are designated by the same reference numerals as in FIG. 3. Elements which serve the same function but which must be slightly modified in construction are designated by the same reference numerals suffixed by an apostrophe. The embodiment of FIG. 4 does not utilize self biasing for the electrode as does the embodiment of FIG. 3 but provides a voltage source shown as a battery 50 for the purpose. The negative terminal of the battery 50 is grounded and the positive terminal is gounded through resistors 52, 54 and 56. The junction between the resistors 52 and 54 is connected to the developing electrode 18' and the junction between the resistors 54 and 56 is connected to the switch 34. With the voltage of the battery 50 designated as $E$, the resistors 52, 54 and 56 are selected in accordance with the following relations $$E\left(\frac{R_{54}}{R_{52}+R_{54}}\right)=V_{B1} \quad (6)$$

$$E\left(\frac{R_{54}+R_{56}}{R_{52}+R_{54}+R_{56}}\right)=V_{B2} \quad (7)$$

where $R_{52}$, $R_{54}$ and $R_{56}$ designate the resistance values of the resistors 54, 54 and 56 respectively.

With the slider 26 in its right position for normal documents, the switch 34 is closed so that the resistors 56 is shorted out. In accordance with equation (6), the voltage $V_{B1}$ is applied to the developing electrode 18. With the slider 26 in its left position for low contrast documents, the switch 34 is open and the voltage applied to the electrode 18 is $V_{B2}$ in accordance with equation (7).

The embodiment of FIG. 4 further comprises another pulley 60 around which the wire 38' is also trained. Still another pulley 70 is carried by the slider 26' around which the wire 38' is trained. Another slider 62 is connected to the wire 38' and has detent projections 62*a*, 62*b*, 62*c*, 62*d* and 62*e*. A detent spring 64 engages with the projections 62*a* to 62*e* to hold the slider 62 in one of four positions. In this embodiment, rightward and leftward movement of the slider 26 will both change the voltage on the developing electrode 18' and move the shutter 46. Rightward and leftward movement of the slider 62 will move the shutter 46 only. The slider 62 makes it possible to select one of several values for the intensity of the light image for low contrast documents. It also makes it possible to reduce the intensity of the light image without increasing the voltage on the electrode 18' to increase the contrast and density of the copy.

The apparatus may comprise a photoconductive member in belt, plate, sheet or any other form as long as a developing electrode is provided.

The intensity of the light image may be changed by means of varying the brightness of the lamp 10. Other modifications will become possible to those skilled in the art after receiving the teachings of the present disclosure.

What is claimed is:

1. A method of electrophotographically duplicating an original document having either normal or low contrast including the steps of radiating a light image of an original document of normal contrast with a first predetermined intensity onto a photoconductive member to form an electrostatic image, developing the electrostatic image using a developing electrode disposed adjacent to the photoconductive member, and a first predetermined voltage being applied to the developing electrode when duplicating an original document having normal contrast, the improvement comprising the steps, when duplicating an original document having low contrast, of:

a. adjusting the light image to have a second predetermined intensity which is lower than the first predetermined intensity, the second predetermined intensity being that at which the rate of change of photoconductivity of the photoconductive member with respect to a change in the intensity of the light image is substantially maximum; and b. applying a second predetermined voltage which is higher than the first predetermined voltage to the developing electrode.

2. The method according to claim 1, in which the light image has dark areas and light areas, the second predetermined intensity being the intensity of the dark areas.

3. The method according to claim 1, in which the second predetermined voltage is predetermined function of the second predetermined intensity and the photoconductivity characteristic of the photoconductive member.

4. The method according to claim 2, in which the second predetermined voltage is substantially equal to a voltage corresponding to the intensity of the light areas.

5. Electrophotographic apparatus comprising:

a photoconductive member;

a developing electrode disposed adjacent to the photoconductive member;

imaging means for radiating a light image of a document onto the photoconductive member;

electric source means for applying an electric voltage to the developing electrode; and control means operative to control the imaging means to adjust the light image to a first predetermined intensity when duplicating documents of normal contrast and to adjust the light image to a second predetermined intensity which is lower than the first predetermined intensity when duplicating documents of low contrast and to control the electric source means to apply a first predetermined voltage to the developing electrode when duplicating documents of normal contrast and to apply a second predetermied voltage to the developing electrode which is higher than the first predetermined voltage when duplicating documents of low contrast, said control means comprising switch means for controlling the electric source means.

6. The apparatus according to claim 5, in which the control means comprises light value means for controlling the imaging means.

7. The apparatus according to claim 5, in which the control means comprises means for controlling the imaging means independently of the electric source means.

8. The apparatus according to claim 5, in which the control meams comprises means for controlling the electric source means independently of the imaging means.

9. The apparatus according to claim 5, in which the control means comprises means for integrally controlling the imaging means and electric source means.

10. The apparatus according to claim 5, in which the control means comprises a light valve for controlling the imaging means, and a control member for integrally controlling the light valve and the switch means.

11. The apparatus according to claim 5, in which the electric source means is constituted by the photoconductive member, a self-bias voltage being induced on the developing electrode by the photoconductive member.

12. The apparatus according to claim 5, in which the second predetermined voltage is a predetermined function of second predetermined voltage is a predetermined function of the second predetermined intensity and the photoconductivity characteristic of the photoconductive member.

13. The apparatus according to claim 12, in which the light image has light areas and dark areas, the second predetermined voltage being substantially equal to a voltage corresponding to the intensity of the light areas.

* * * * *